US005417338A

United States Patent [19]

Roy et al.

[11] Patent Number: 5,417,338

[45] Date of Patent: May 23, 1995

[54] CONTAINER FOR SEGREGATING WASTE MATERIALS

[75] Inventors: Pierre J. Roy, Lenoxville; Denis Houle, Blainville, both of Canada

[73] Assignee: Nova Sylva Inc., Canada

[21] Appl. No.: 989,989

[22] Filed: Dec. 11, 1992

[51] Int. Cl.[6] ..... A47G 19/00

[52] U.S. Cl. ..... 220/23.86; 220/23.4; 220/23.83; 220/523; 220/528; 220/532; 220/543; 220/909; 220/404; 232/43.2; 232/43.5

[58] Field of Search ..... 220/23.4, 23.6, 23.83, 220/23.86, 523, 528, 532, 543, 909, 404; 232/43.1, 43.2, 43.5

[56] References Cited

U.S. PATENT DOCUMENTS

| | | | |
|---|---|---|---|
| 470,673 | 3/1892 | Heath . | |
| 1,277,412 | 9/1918 | Hardart, Jr . | |
| 2,828,177 | 3/1958 | Johnson . | |
| 2,839,322 | 6/1958 | Kirk . | |
| 3,175,873 | 3/1965 | Blomquist et al. . | |
| 3,511,549 | 5/1970 | Macaluso . | |
| 3,521,937 | 7/1970 | Buhrmaster et al. . | |
| 3,767,280 | 10/1973 | McLaughlin . | |
| 3,776,007 | 12/1973 | Himsl . | |
| 3,883,200 | 5/1975 | Latham . | |
| 3,885,558 | 6/1975 | Himsl . | |
| 3,927,786 | 12/1975 | Aboud | 220/404 X |
| 3,991,595 | 11/1976 | Bahry et al. . | |
| 4,239,309 | 12/1980 | De Fouw et al. . | |
| 4,246,769 | 1/1981 | McLaughlin . | |
| 4,429,930 | 2/1984 | Blouin . | |
| 4,457,569 | 7/1984 | Scheerhorn . | |
| 4,609,233 | 9/1986 | Walla . | |
| 4,662,689 | 5/1987 | Chatterson et al. . | |
| 4,878,592 | 11/1989 | Lee | 220/23.83 |
| 4,905,853 | 3/1990 | Strawder | 220/404 X |
| 4,967,900 | 11/1990 | Gossett | 220/404 |
| 5,022,548 | 6/1991 | Stakis | 220/23.83 |
| 5,111,958 | 5/1992 | Witthoeft | 220/524 |
| 5,127,538 | 7/1992 | Bach | 220/529 |
| 5,169,012 | 12/1992 | Labrie | 220/23.8 |
| 5,246,151 | 9/1993 | Jabara | 224/42.42 |

FOREIGN PATENT DOCUMENTS

| | | | |
|---|---|---|---|
| 3531554 | 3/1987 | Germany | 220/909 |

*Primary Examiner*—Gary E. Elkins
*Assistant Examiner*—Stephen Cronin
*Attorney, Agent, or Firm*—Lerner, David, Littenberg, Krumholz & Mentlik

[57] ABSTRACT

A waste container is designed to accommodate sorting of waste in a plurality of basic categories, such as recyclables, compostables, and terminal wastes. The container is constructed from a plurality of individual components which may be assembled for use. The container includes a floor supported large receptacle which supports a hollow shell having a closable lid. One or more smaller receptacles are supported within the shell overlying the larger opening. The shell and smaller receptacles are configured to provide a passageway therebetween to allow direct access to the larger receptacle without disturbing the container's assembled relationship.

49 Claims, 6 Drawing Sheets

CONTAINER FOR SEGREGATING WASTE MATERIALS

FIELD OF THE INVENTION

The present invention is generally directed to waste containers of a type normally found and used in a typical kitchen, and more particularly, to a compartmentalized waste container which allows separation of different types of waste within the container such as compostables, terminal wastes, and recyclable materials which are to be disposed of separately.

BACKGROUND OF THE INVENTION

In recent years, increasing efforts and a corresponding public awareness have been directed toward the reclamation and re-use of recyclable waste and like materials, such as aluminum cans and containers, glass containers and other glass articles, and newspaper and similar paper products, which have traditionally been simply discarded. As is known, considerable cost savings, as well as more efficient management and use of natural resources necessary to produce such items may be realized by reclaiming and recycling such items. In addition, the reclamation and re-use of recyclable waste reduces the amount of such items being placed in landfills which are rapidly becoming filled which has necessitated ocean dumping and the attendant pollution of our oceans and the ecological harm resulting therefrom.

To this end, many towns and municipalities throughout the United States are enacting ordinances requiring that homeowners or business establishments separate the waste into different categories, for example, trash which will be disposed of at a garbage damp, landfill site and/or incineration plant, recyclable materials which may be re-used in producing new products, and compostable materials which may be composted in a backyard composter or collected for centralized composting.

Despite the obvious benefits obtained from the reclamation and recycling of those items as aforementioned, various disadvantages and problems to the individual member of the household or business establishment have prevented broad scale public acceptance and participation in organized recycling and composting efforts. Principally, individuals object mostly to the greater space requirements and efforts necessary to segregate and store several different types of recyclable items, as well as the continuing necessity to collect, and dispose of non-recyclable waste and refuse. As will be understood, until the segregated collection of recyclable items can be made less burdensome and more convenient to the individual members of the public, the majority of the public will remain unwilling to participate in organized reclamation programs.

There are known a number of designs for compartmented waste containers such as from Jones, U.S. Pat. No. 4,893,722, Waterston, U.S. Pat No. 5,092,480, Crine, U.S. Pat. No. 4,834,253, Lee, U.S. Pat. No. 4,878,592, and Lombardi, et al., U.S. Pat. No. 4,893,719. However, despite the utility of these containers, such containers have not satisfied the needs of the individual members of the public for segregating and storing recyclable materials in a manner to promote participation in the reclamation and recycling effort as mandated by currently enacted ordinances.

SUMMARY OF THE INVENTION

Accordingly, objects of the present invention include the overcoming or avoiding of one or more of the problems and difficulties of the types discussed above, together with the obtaining of the novel advantages hereinafter disclosed.

Another object of the present invention is to provide a container for segregating waste materials which requires no greater space requirements than conventional trash collection containers as typically found in the residential kitchen.

Another object of the present invention is to provide a container for segregating waste materials which have an aesthetically pleasing appearance, such that it can be used acceptably within a residential kitchen or the like.

Another object of the present invention is to provide a container for segregating waste materials which is easily handled and transportable in the filled state.

Another object of the present invention is to provide a container for segregating waste materials into different categories which can be readily assembled and easily cleaned.

Another object of the present invention is to provide a container for segregating waste materials which readily provides for separation and/or segregation of different types of waste at the time of collecting or depositing into the container as the waste becomes available.

Another object of the present invention is to provide a container for segregating waste materials which is compact in nature, yet provides readily accessible openings to the separate containers for the individual categories of waste.

Another object of the present invention is to provide a container for segregating waste materials which is constructed of a minimum number of elements, such that use and storage is simplified.

Another object of the present invention is to provide a container for segregating waste materials which achieves the foregoing objects together with maintaining minimum costs of production.

In accordance with one embodiment of the present invention there is provided a container for segregating materials, the container comprising a shell having open opposed ends, a first receptacle having an open top removably supporting one open end of the shell to provide communication between the interiors thereof, and a second receptacle removably supported within the shell, the second receptacle having a portion spaced from a portion of the shell to form a passageway in communication between another open end of the shell and the interior of the first receptacle.

In accordance with another embodiment of the present invention there is provided a container for segregating materials, the container comprising a shell having top and bottom ends each provided with an opening therein, a first receptacle having a top end provided with an opening therein and a closed bottom end, the top end of the first receptacle removably supporting the bottom end of the shell with the openings thereof in at least partial alignment with each other to provide communication between the interiors thereof, a second receptacle removably supported within the shell, the second receptacle having a wall spaced from a wall of the shell to form a passageway therebetween, the passageway providing communication between the opening in the top end of the shell and the interior of the first receptacle through the at least partially aligned openings within the bottom end of the shell and the top end of the first receptacle, and a lid moveably overlying the opening in the top end of the shell between an opened and closed position.

In accordance with another embodiment of the present invention there is provided a container for segregating materials, the container comprising a hollow shell having top and bottom ends each provided with an opening therein and front and rear spaced apart walls, the front wall having an inclined portion extending outwardly from the bottom end to the top end, a first receptacle having a top end provided with an opening therein and a closed bottom end, the top end of the first receptacle removably supporting the bottom end of the shell with the openings thereof in at least partial alignment with each other, a second receptacle removably supported within the shell adjacent the rear wall thereof, the second receptacle having an inclined front wall spaced from at least the inclined portion of the shell to form an inclined passageway therebetween, the passageway in communication between the opening within the top end of the shell and the interior of the first receptacle through the at least partially aligned openings within the bottom end of the shell and the top end of the first receptacle and a lid moveable between an opened and closed position overlying the opening in the top end of the shell, the lid when in the opened position providing access to the interior of the first receptacle through the passageway and the interior of the second receptacle through the opening within the top end of the shell.

BRIEF DESCRIPTION OF THE DRAWINGS

The above description, as well as further objects, features and advantages of the present invention will be more fully understood with reference to the following detailed description of a container for segregating waste materials, when taken in conjunction with the accompanying drawings, wherein.

DETAILED DESCRIPTION OF THE PREFERRED EMBODIMENT

Figure 1:
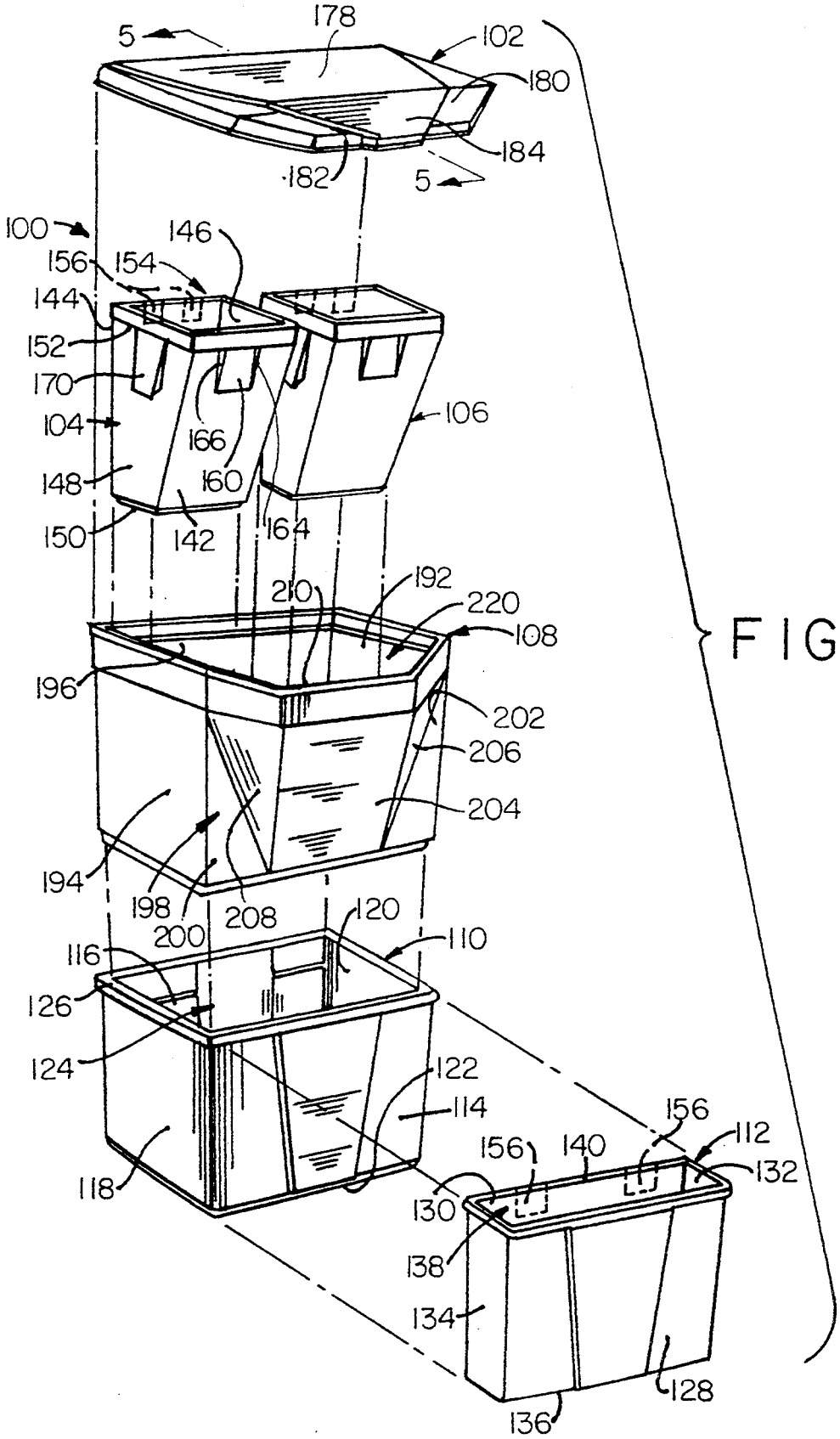
FIG. 1 is an exploded unassembled perspective view of a container for segregating waste materials constructed in accordance with the present invention showing the individual components thereof for segregating waste materials into miscellaneous categories such as recyclables, compostables, and terminal waste.
Figure 11:
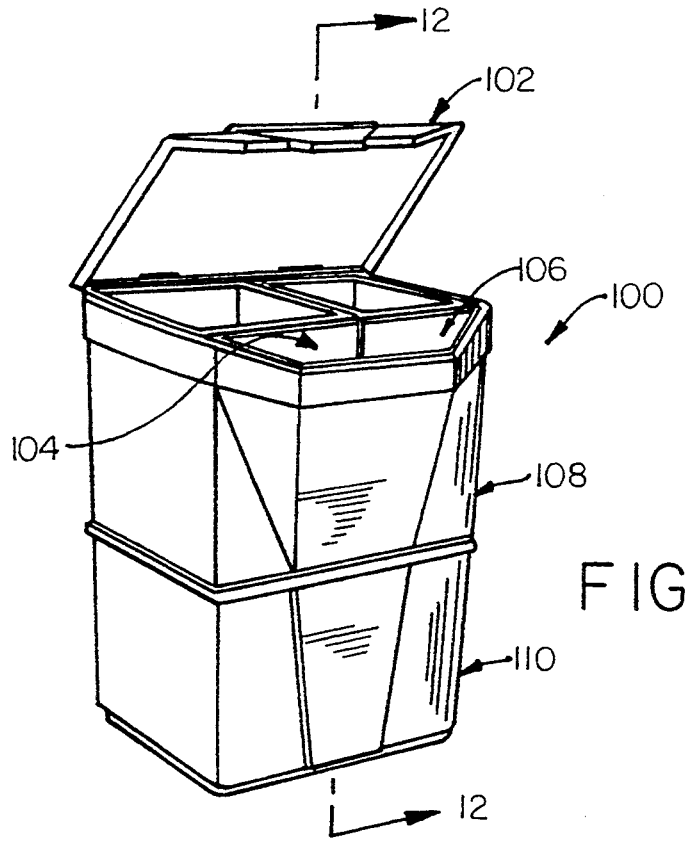
FIG. 11 is a perspective view of an assembled container for segregating waste materials into different categories in accordance with one embodiment of the present invention.

Referring now to the drawings, wherein like reference numerals represent like elements, there is shown in FIG. 1 an unassembled exploded view of the components of a container 100 constructed in accordance with one embodiment of the present invention. The container 100 is constructed from a plurality of individual components which may be assembled into a complete container for use as shown in FIG. 11, as well as being disassembled into its individual components as shown in FIG. 1 for separately emptying the contents thereof. The components of the container 100 include a lid 102, one or more small receptacles 104, 106, a shell 108 having a hollow uninterrupted interior, a large receptacle 110, and optionally an auxiliary receptacle 112. Each of the components of the container 100 can be constructed from a variety of materials, and preferably, from plastic material which enables the use of mass production techniques such as molding, forming, and the like.

The large receptacle 110 has a generally rectangular shape being formed from spaced front and rear walls 114, 116, spaced sidewalls 118, 120, and a bottom wall 122. The bottom wall 122 enables stable support of the receptacle 110 on a supporting surface such as a kitchen floor or the like. The receptacle 110 has a top opening 124 defined by the upper edge of the receptacle walls 114, 116, 118, 120, which upper edge is in the nature of an inverted U-shaped rim 126. The auxiliary receptacle 112 is similarly constructed to include spaced front and rear walls 128, 130, spaced sidewalls 132, 134, bottom wall 136, and top opening 138 which is surrounded by an inverted U-shaped rim 140. The auxiliary receptacle 112 via its bottom wall 136 is likewise constructed for sturdy support on a kitchen floor or the like. The particular shape of the auxiliary receptacle 112 is generally rectangular while being somewhat smaller than the shell 108 and the large receptacle 110. This enables the auxiliary receptacle 112 to be supported within the interior of the shell 108 overlying the top opening 124 in the large receptacle 110 as to be described hereinafter.

Figure 2:
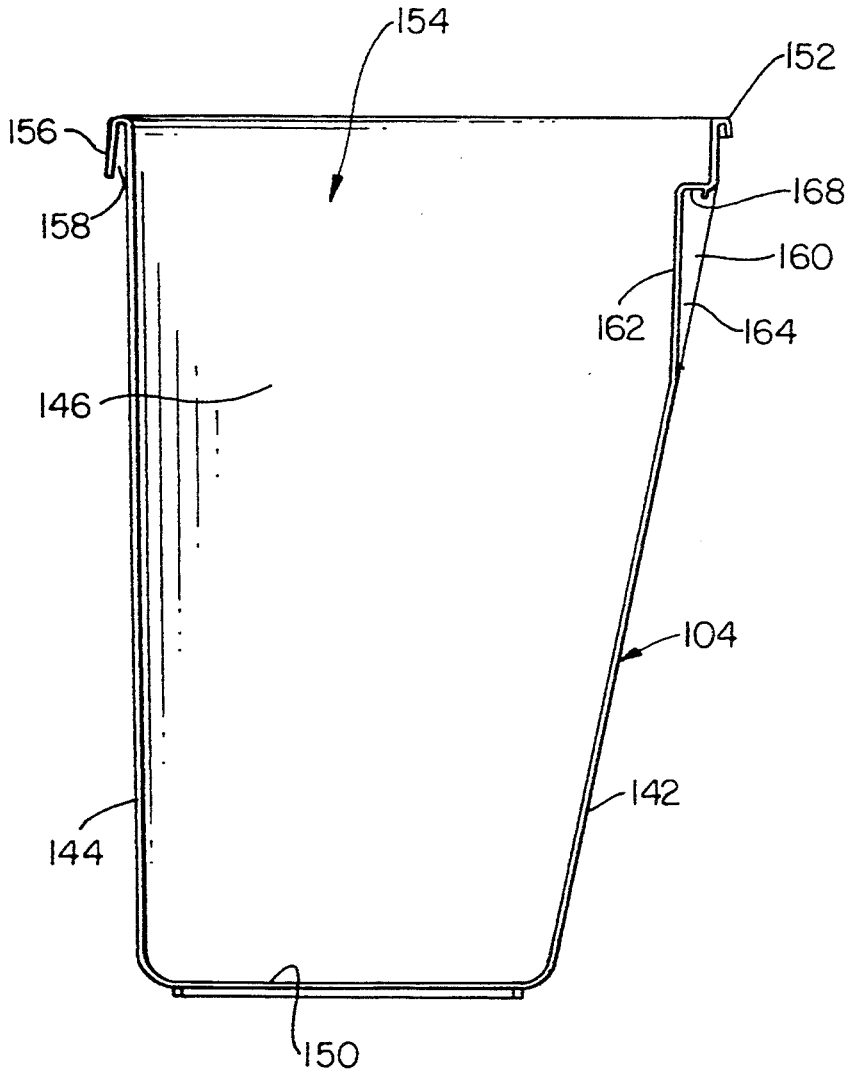
FIG. 2 is a cross sectional view of one of the small receptacles received within the container shell taken along Lines 2—2 in FIG. 1.
Figure 3:
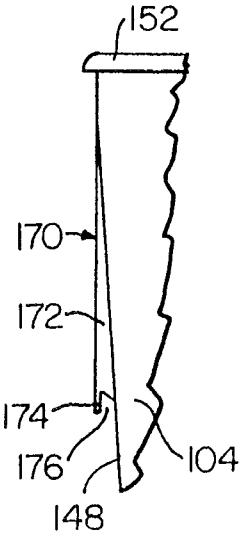
FIG. 3 is a cross sectional view of a portion of the sidewall of the small receptacle showing a plastic bag attaching assembly taken along Lines 3—3 in FIG. 1.

Turning now to FIGS. 1-3, there will be described the construction of one of the small receptacles 104, 106, the other receptacle being substantially identical thereto. The receptacle 104 includes spaced front and rear walls 142, 144, spaced sidewalls 146, 148, and a bottom wall 150. The top edge of the receptacle walls 142, 144, 146, 148 is constructed in the nature of an inverted U-shaped rim 152 which defines a top opening 154 providing access to the interior of the receptacle 104. The rim 152 along rear wall 144 supports a pair of spaced apart downwardly depending flanges 156 which form an opening 158 of sufficient size to releasably receive a portion of the shell 108 for removably supporting the receptacles 104, 106 as to be described hereinafter.

The front wall 142 is arranged at an incline to the rear wall 144, for example, in the range of about 10°–15° from vertical. As a result, the top opening 154 is substantially larger than the size of the bottom wall 150. In all other respects, the receptacle 104 is generally of rectangular design. A recess 160 is centrally formed within an upper portion of the front wall 142 by means of a vertical wall portion 162. The recess 160 is surrounded on three sides by a pair of spaced sidewalls 164, 166 and a horizontal lip 168. The recess 160 facilitates the carrying of the receptacles 104, 106 by supporting the front wall 142 using ones fingers upon engagement with the lip 168.

As previously mentioned, the small receptacles 104, 106 are supported within the shell 108 by the flanges 156. The receptacles 104, 106 are sized to enable a pair of receptacles to be arranged side-by-side within the shell 104 as shown in FIG. 1. However, it is contemplated that a single larger receptacle may be used instead of the two small receptacles 104, 106 if desired. To this end, and by way of example, the auxiliary receptacle 112 is provided with similar flanges 156 depending from rim 140 along the rear wall 130 so as to be removably supported within the shell 108. However, it is noted that the front wall 128 of the auxiliary receptacle 112 is generally parallel to the rear wall 130 thereof. For this reason, as will be understood from a further discussion of the present inventions the front to back dimension of top opening 138 within the auxiliary receptacle 112 is smaller than the front to back dimension of the top opening 154 within the small receptacles 104, 106, and more particularly, generally corresponds to the front to back dimension of the bottom wall 150 of the small receptacles 104, 106.

The sidewalls 146, 148 are each provided with a trash bag attaching assembly 170 as best shown in FIG. 3. The assembly 170 is constructed from a wedge shaped body 172 having a downwardly depending extension 174 which forms an opening 176 with a respective sidewall 146, 148. A plastic trash bag may be inserted within a receptacle 104, 106 and the upper portion thereof folded downwardly over the assembly 170 and retained within the opening 176 by means of the extension 174. The trash bag attaching assembly 170 enables the convenient releasable attachment of a trash bag within the receptacles 104, 106 to prevent contamination or fouling of the receptacle by the disposed materials for which the receptacle is being used. In particular, it has been found that shopping plastic bags of the grocery type may be used in the receptacles 104, 106 with the bag handles as typically provided on the bags received within the openings 176 and retained by the extensions 174.

Figure 4:
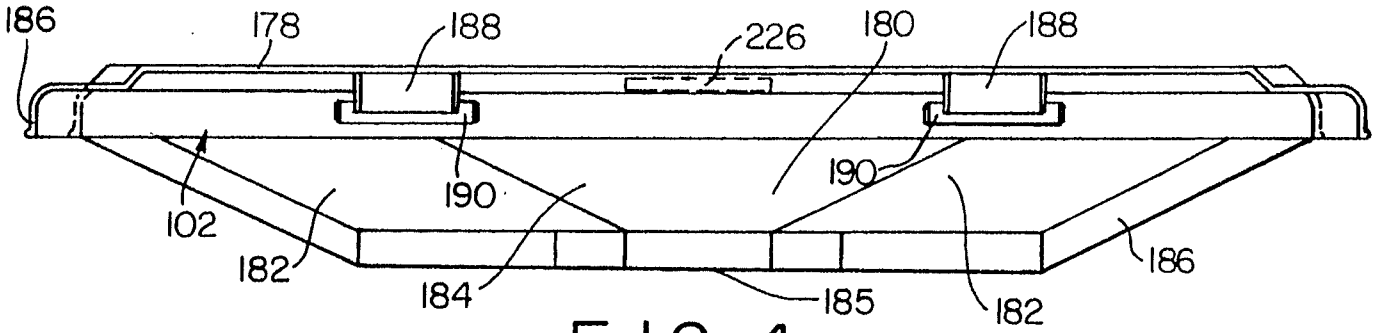
FIG. 4 is a rear elevational view of the container lid adapted for rotational mounting to the container shell.
Figure 5:
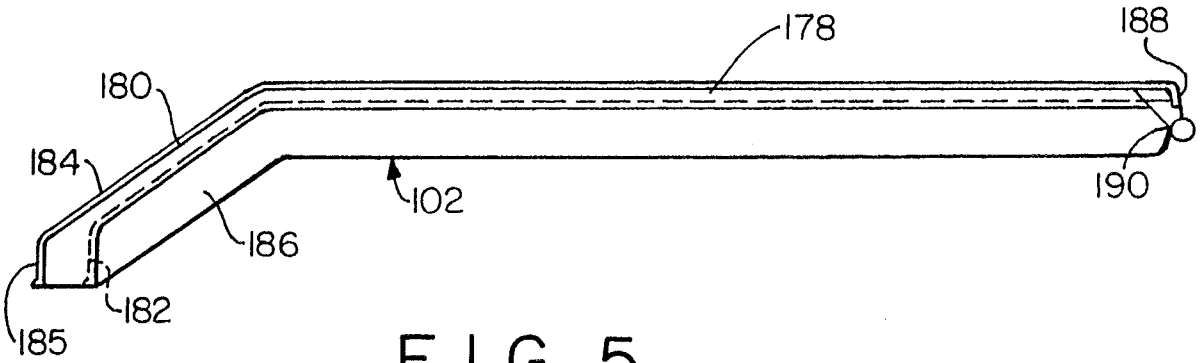
FIG. 5 is a cross sectional view of the container lid taken along Lines 5—5 in FIG. 1.

Once again referring to FIG. 1, and more particularly to FIGS. 4 and 5, there will be described the construction of the lid 102. The lid 102 is constructed in the nature of a generally flat shell having a horizontal top wall 178 which is joined to an inclined front wall 180 arranged, for example, at about 30° to horizontal. The front wall 180 is constructed of two tiers 182, 184, the upper tier 184 having an extension 185 extending beyond the lower tier 182. The extension 185 functions as a handle for raising the lid when sealed in closed relationship with the shell 108. Except for the rear edge of the top wall 178, the top wall and front wall 180 are circumscribed by a downwardly depending lip 186. A pair of flanges 188 are attached in spaced apart relationship depending downwardly from the rear edge of the top wall 178. The flanges 188 at their lower extremity support a horizontally arranged solid rod 190 which functions as a hinge in releasably attaching the lid 102 to the shell 108 as to be described.

Figure 6:
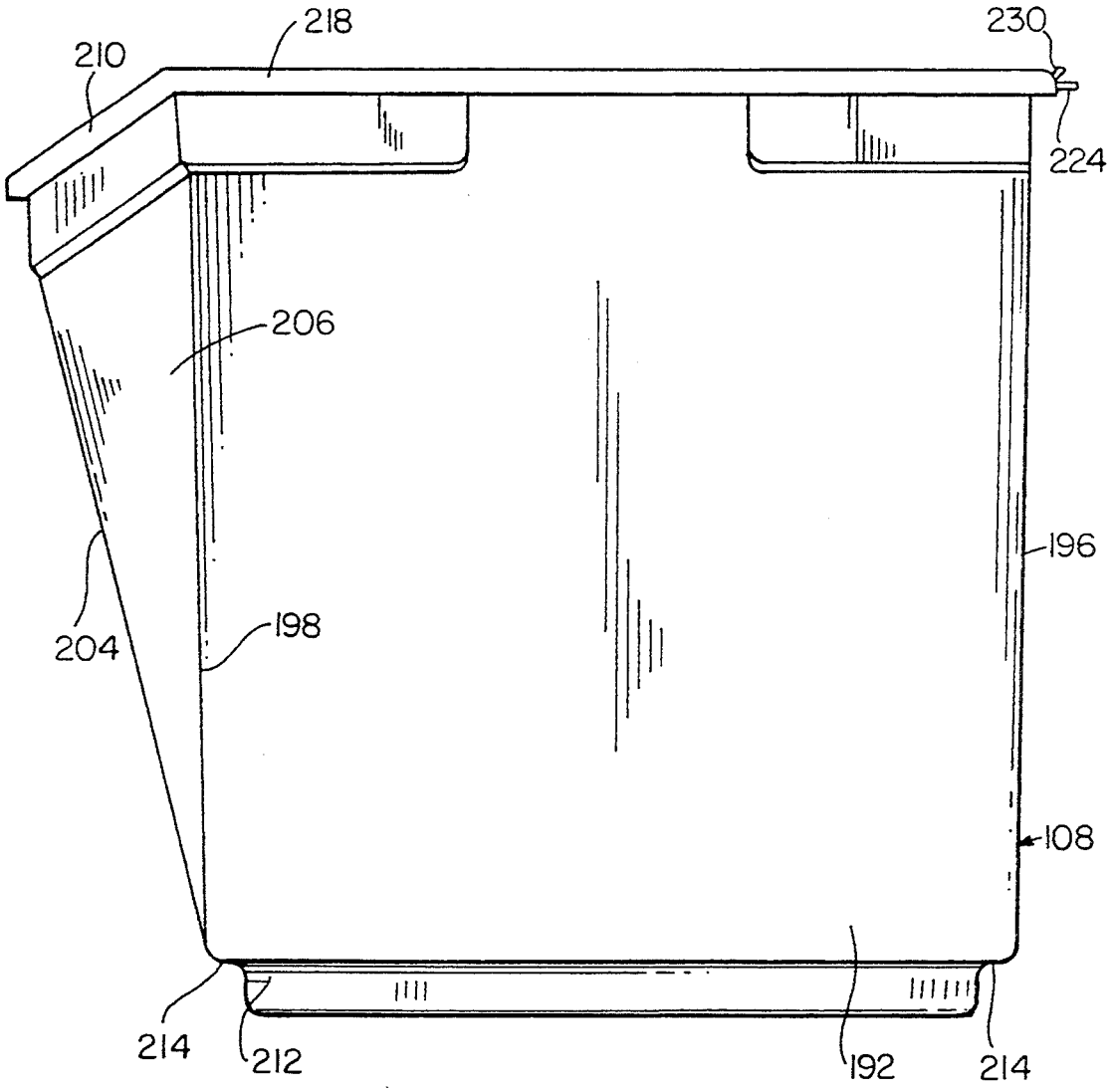
FIG. 6 is a side elevational view of the container shell having an inclined frontwall.

Turning to FIGS. 1 and 6, there will be described the construction of the shell 108. The shell 108 includes a pair of spaced sidewalls 192, 194 and a pair of spaced rear and front walls 196, 198. The front wall 198 is uniquely configured by including a pair of triangular shaped panels 200, 202 which are respectively attached to the sidewalls 192, 194. A generally rectangular shaped wall portion 204 extends outwardly at an incline from the lower edge of the panels 200, 202 and is joined thereto by means of triangular shaped lateral gussets 206, 208. The wall portion 204 is arranged at an angle to the vertical of about 30°, and more particularly, so as to be parallel to the front wall 142 of the small receptacles 104, 106. Similarly, the upper edge 210 of gussets 206, 208 are arranged at an angle to the horizontal of about 10°–15° so as to be parallel with the incline front wall 180 of the lid 102.

The bottom end of the shell walls 192, 194, 196, 198 is formed to include a circumscribing recessed vertical lip 212 having a generally horizontal ledge 214 which defines a rectangular bottom opening 216. The top edge of the shell walls 192, 194, 198, and a portion of the rear wall 196 are formed with an inverted U-shaped rim 218 which defines a top opening 220 which has a greater open area than the bottom opening 216 by virtue of the construction of the front wall 198 to include the outwardly inclined wall portion 204.

Figure 7:
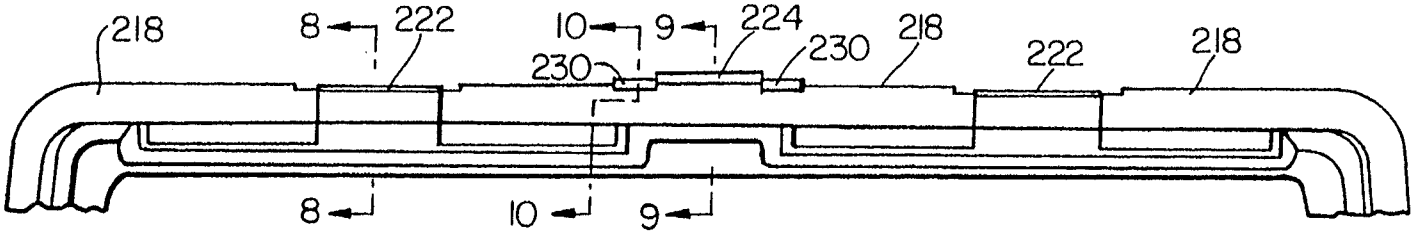
FIG. 7 is a top plan view of a rear edge portion of the container shell showing its construction for rotationally supporting the lid.
Figure 9:
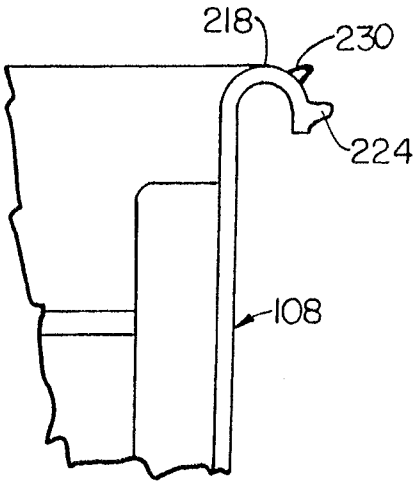
FIG. 9 is a cross sectional view of the rear edge portion of the container shell taken along Lines 9—9 in FIG. 7.
Figure 8:
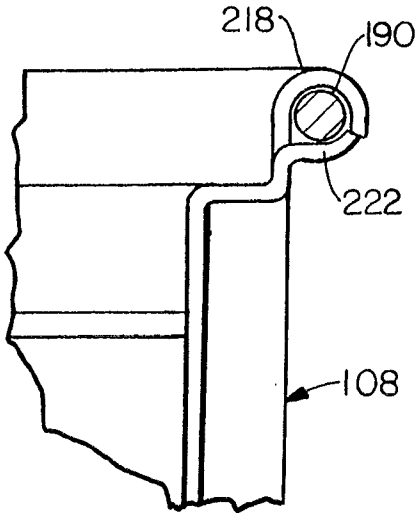
FIG. 8 is a cross sectional view of the rear edge portion of the container shell taken along Lines 8—8 of FIG. 7.

Turning now to FIGS. 7–9, there will be described the construction of the upper edge 210 along the rear wall 196 of the shell 108. With particular reference to FIGS. 7 and 8, the inverted U-shaped rim 218 inwardly of the sidewalls 192, 194 is replaced for a short distance by an upwardly curved lip 222 having a radius of curvature approximately equal to the inside radius of curvature of the rim. The lip 222 is at least as long as the width of the flanges 188 on lid 102. By virtue of this construction, the lid 102 may be pivotally attached to the shell 108 for rotation about the longitudinal axis of the rods 190. In this regard, the rods 190 are rotationally supported on the surface of lip 122 while being retained by their ends, which extend beyond flanges 188 and are received within the interior of the inverted U-shaped rim 218 which extend on either side of the lip. This construction enables the lid 102 to be rotated between opened and closed positions with respect to the top opening 220 of the shell 108.

Two safety features which prevent the lid 102 from inadvertently closing when in an opened position and from opening beyond approximately 90° to horizontal will now be described. A central section of the rim 218 is provided with a generally horizontal ledge 224 extending rearwardly as best shown in FIGS. 7 and 9. The ledge 224 acts as a rotational stop by engaging a rear portion of the lid 102, such as along location 226 as shown in FIG. 4. The ledge 224 prevents the lid 102 from rotating generally past a vertical orientation when opening the lid during use of the container 100.

Figure 10:
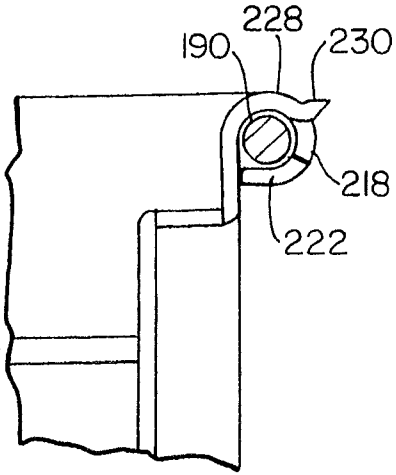
FIG. 10 is a cross sectional view of the rear edge portion of the container shell taken along Lines 10—10 in FIG. 7.

Turning to FIG. 10, on either side of the ledge 224, there is provided a short segment of a downwardly curved lip 228 having an upwardly extending projection 230 arranged at about approximately 45° to horizontal. As the lid 102 is rotated into an opened position, location 226 along the rear of the lid initially engages the projection 230 which functions as a temporary stop. By the application of a slight force to the lid 102, the interference effect of the projection 230 is overcome to allow the lid to rotate further until engagement with ledge 224. At this time, the rear edge of the lid 102 in location 226 is captured between ledge 224 and projection 230. The projection 230 prevents the lid 102 from inadvertently closing, while ledge 224 prevents the lid from opening to a greater degree than necessary for use of the container 100. The lid 102 is closed by applying a sufficient force to overcome the interference of the projection 230.

Figure 12:
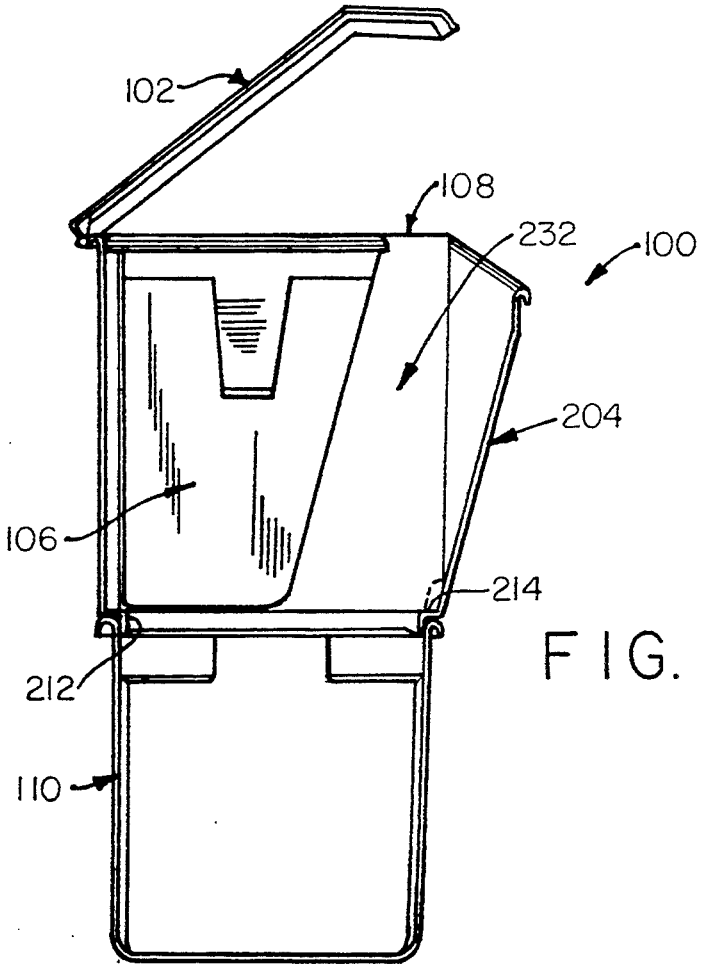
FIG. 12 is a cross sectional view of the assembled container constructed in accordance with the present invention taken along Lines 11—11 in FIG. 11 showing the relationship between the small suspended receptacle and the shell to form an inclined passageway therebetween.

The assembly of the components of the container 100 and the use thereof will now be described with reference to FIGS. 11 and 12. The large receptacle 110 is positioned with its bottom wall 122 firmly supported at the location in which the container 100 is to be used. The shell 108 is supported on the large receptacle 110 by the recessed lip 212 being received within the top opening 124 of the receptacle with the horizontal ledge 224 of the shell firmly supported by the rim 126 of the receptacle. This arrangement enables the ledge 224 to function as a pseudo-hinge to permit opening and closing of the shell 108 with respect to the large receptacle 110 upon tilting of the shell about one side thereof. Providing direct access into the interior of the large receptacle 110 by tilting of the shell 108 is designed to accommodate large items of waste materials which would not otherwise be receivable through the shell during normal use of the container 100 as to be described hereinafter.

With the lid 102 in an opened position, the small receptacles 104, 106 are supported within the interior of the shell 108. Support is achieved by the flanges 156 on the small receptacles 104, 106 capturing within their openings 158 a portion of the upper edge of the rear wall 196 of the shell 108 at locations on either sidle of the extent of upwardly curved lip 222. The small receptacles 104, 106 are positioned in side-by-side relationship with their front walls 142 opposing the front wall 198 of the shell 108, and more particularly, the inclined wall portion 204. This arrangement results in the formation of an inclined passageway 232 therebetween as best shown in FIG. 12. The passageway 232 provides direct communication between the top opening 220 within the shell 108 and the interior of the large receptacle 110 via its top opening 224. The lid 102 is rotationally attached to the shell 108 as previously described. Optionally, a plastic trash bag may be inserted within the interior of the small receptacles 104, 106 and secured by means of the attaching assemblies 170 as previously described.

In user the container 100 is positioned at a convenient location such as in a household kitchen, garage, or the like. The lid 102 is opened by grabbing extension 185 to provide access to the small receptacles 104, 106 and the passageway 232 which communicates with the interior of the large receptacle 110. The large receptacle 110 may be used for recyclable waste, such as newspapers, miscellaneous fine or craft paper, cardboard containers, plastic containers or objects, metal containers or objects, glass containers or objects, and the like. To dispose of such recyclable waste, the waste may be dropped through the passageway 232 where it is received within the large receptacle 110. If the recyclable waste is too large for the passageway 232, the shell 108 may be removed from the large receptacle 110 or tilted in a hingelike manner as previously described to provide direct access to the large receptacle.

The small receptacles 104, 106 may be used for compostables, terminal waste, or the like. For example, one of the small receptacles 104 may be used for peels, table scraps, coffee and coffee filters, plant scraps, and the like. On the other hand, the other receptacle 106 may be used for terminal waste or non-recyclables such as paper napkins, used paperwear, non-recyclable empty product containers, and the like. The small receptacles 104, 106 may be easily emptied by removing the receptacle from attachment to the shell 108 or by withdrawing the plastic trash bag if used.

For additional storage capacity, the auxiliary receptacle 112 may be positioned on the floor adjacent the front wall 114 of the large receptacle 110. This provides a fourth storage receptacle for other types of waste materials. In addition, the small receptacles 104, 106 may be replaced by the auxiliary receptacle 112 within the interior of the shell 108. In this regard, the front wall 128 of the auxiliary receptacle 112 forms the passageway 232 with the wall portion 204 of the shell 108.

As described, the container 100 is designed to allow the source sorting of household waste materials. The container 100 is modular and compartmented with a plurality of receptacles to be used as the consumer desires. The inside surface of the lid 102 can be provided with pre-printed material giving guidance to the different users of the household as to the receptacle selection for each type of waste material. The container 100 promotes sorting of waste material in three basic categories, recyclables, compostables, and terminal waste, which benefits participation in organized reclamation programs.

Although the invention herein has been described with references to particular embodiments, it is to be understood that the embodiments are merely illustrative of the principles and application of the present invention. It is therefore to be understood that numerous modifications may be made to the embodiments and that other arrangements may be devised without departing from the spirit and scope of the present invention as defined by the claims.

What is claimed is:

1. A container for segregating materials, said container comprising a shell having opposed open ends, a first receptacle having an open top removably supporting one said open end of said shell to provide communication between the interiors thereof, and a second receptacle removably supported within said shell, said second receptacle having a portion spaced from a portion of said shell to form an open passageway extending in communication between the other said open end of said shell and the interior of said first receptacle, whereby material to be segregated is disposable into said first receptacle through said passageway while said second receptacle is supported within said shell.

2. The container of claim 1, wherein said shell includes a front wall having an inclined portion extending outwardly from one said open end of said shell to the other said open end thereof, said inclined portion and the portion of said second receptacle forming said passageway.

3. The container of claim 2, wherein the portion of said second receptacle forming said passageway is arranged at an incline parallel to said incline portion of said front wall.

4. The container of claim 2, wherein said inclined portion of said front wall is spaced from the remainder of said front wall by a pair of spaced gussets.

5. The container of claim 1, wherein said open top of said first receptacle is configured to conform to the configuration of one said open end of said shell for removable support thereof.

6. The container of claim 1, further including a third receptacle removably supported within said shell adjacent said second receptacle, said third receptacle having a portion thereof spaced from a portion of said shell to form a portion of said passageway.

7. The container of claim 1, wherein said second receptacle further includes securing means for releasably securing said second receptacle to said shell.

8. The container of claim 7, wherein said securing means comprises at least one downwardly depending flange forming an opening for receiving a portion of said shell.

9. The container of claim 1, further including a lid moveably overlying said another open end of said shell.

10. The container of claim 1, wherein said second receptacle at least partially obstructs said communication between said open ends of said shell.

11. The container of claim 1, wherein said shell includes at least a partially unobstructed interior providing direct communication between its opposed open ends, said unobstructed interior forming a portion of said open passageway.

12. The container of claim 1, wherein said second receptacle includes a bottom wall overlying and at least partially obstructing said open top of said first receptacle.

13. The container of claim 1, wherein said opposed ends of said shell comprise an open top and an open bottom, said open passageway extending through said shell from said open top to said open bottom.

14. A container for segregating materials, said container comprising a shell having top and bottom ends each provided with an opening therein, a first receptacle having a top end provided with an opening therein and a closed bottom end, said top end of said first receptacle removably supporting said bottom end of said shell with said openings thereof in at least partial alignment with each other to provide communication between the interiors thereof, a second receptacle removably supported within said shell, said second receptacle having a wall spaced from a wall of said shell to form a passageway therebetween, said passageway providing communication between said opening in said top end of said shell and the interior of said first receptacle through the at least partially aligned openings within said bottom end of said shell and said top end of said first receptacle, whereby material to be segregated is disposable into said first receptacle through said passageway while said second receptacle is supported within said shell, and a lid moveably overlying said opening in said top end of said shell between an opened and closed position.

15. The container of claim 14, where said wall of said shell includes an inclined portion extending outwardly from said bottom end to said top end of said shell, said inclined portion and said wall of said second receptacle forming said passageway.

16. The container of claim 15, wherein said wall of said second receptacle forming said passageway is arranged at an incline parallel to said wall of said shell forming said passageway.

17. The container of claim 15, wherein said wall of said shell forming said passageway is spaced from the remainder of said shell by a pair of spaced triangular shaped gussets.

18. The container of claim 14, wherein said top end of said first receptacle is configured to conform to the configuration of said bottom end of said shell for removable support thereof.

19. The container of claim 18, wherein the configuration of said top end of said shell is different from the configuration of said bottom end of said shell.

20. The container of claim 14, further including a third receptacle removably supported within said shell adjacent said second receptacle.

21. The container of claim 20, wherein said wall of said shell forming said passageway extends outwardly from said bottom end to said top end of said shell, said walls of said second and third receptacles forming with said wall of said shell said passageway therebetween.

22. The container of claim 14, wherein said second receptacle further includes securing means for releasing securing said second receptacle to said shell.

23. The container of claim 22, wherein said securing means comprises at least one downwardly depending flange forming an opening for receiving a portion of said shell.

24. The container of claim 14, wherein said opening in said top end of said shell is larger than said opening in said bottom end of said shell, the differences between said openings forming a portion of said passageway therebetween.

25. The container of claim 14, wherein said shell has a lower rim surrounding said bottom end thereof and said first receptacle having a top rim surrounding said top end thereof, said lower rim nestable within said top rim for support of said shell by said first receptacle.

26. The container of claim 14, wherein said shell includes a rim surrounding a portion of said top end of said shell, said rim including preventing means for preventing movement of said lid in said opened position beyond a predetermined limit.

27. The container of claim 26, wherein said preventing means comprises a ledge extending outwardly from said rim for engaging a portion of said lid to prevent movement thereof beyond said predetermined limit.

28. The container of claim 26, further including retaining means for releasably retaining said lid in a predetermined opened position.

29. The container of claim 28, wherein said retaining means comprises a projection extending outwardly from said rim, said rim forming a space with said preventing means for receiving a portion of said lid when said lid is arranged in said opened position.

30. A container for segregating materials, said container comprising a hollow shell having top and bottom ends each provided with an opening therein and front and rear spaced apart walls, said front wall having an inclined portion extending outwardly from said bottom end to said top end, a first receptacle having a top end provided with an opening therein and a closed bottom end, said top end of said first receptacle removably supporting said bottom end of said shell with said openings thereof in at least partial alignment with each other, a second receptacle removably supported within said shell adjacent said rear wall thereof, said second receptacle having an inclined front wall spaced from at least said inclined portion of said shell to form an inclined passageway therebetween, said passageway in communication between said opening within said top end of said shell and the interior of said first receptacle through the at least partially aligned openings within said bottom end of said shell and said top end of said first receptacle, and a lid moveable between an opened and closed position overlying said opening in said top end of said shell, said lid when in said opened position providing access to the interior of said first receptacle through said passageway and the interior of said second receptacle through the opening within said top end of said shell.

31. The container of claim 30, wherein said inclined portion of said shell and said inclined front wall of said second receptacle are parallel to each other.

32. The container of claim 30, further including a third receptacle removably supported within said shell adjacent said second receptacle and said rear wall, said second receptacle having an inclined front wall spaced from at least said inclined portion of said shell to form with said inclined front wall of said second receptacle said passageway.

33. The container of claim 32, wherein said inclined portion of said shell is parallel to said front walls of said second receptacle and said third receptacle.

34. The container of claim 30, wherein said top end of said first receptacle is configured to conform to the configuration of said bottom end of said shell for removable support thereof.

35. The container of claim 34, wherein the configuration of said top end of said shell is different from the configuration of said bottom end of said shell.

36. The container of claim 30, wherein said second receptacle includes securing means for releasing securing said second receptacle to a wall of said shell.

37. The container of claim 30, wherein said opening in said top end of said shell is larger than said opening in said bottom end of said shell, the differences between said openings forming a portion of said passageway therebetween.

38. The container of claim 30, wherein said shell has a lower rim surrounding said bottom end thereof and said first receptacle having a top rim surrounding said top end thereof, said lower rim nestable within said top rim for support of said shell by said first receptacle.

39. The container of claim 30, wherein said shell includes a rim surrounding a portion of said top end of said shell, said rim including preventing means for preventing movement of said lid in said opened position beyond a predetermined limit.

40. The container of claim 39, wherein said preventing means comprises a ledge extending outwardly from said rim for engaging a portion of said lid to prevent movement thereof beyond said predetermined limit.

41. The container of claim 39, further including retaining means for releasably retaining said lid in a predetermined opened position.

42. The container of claim 41, wherein said retaining means comprises a projection extending outwardly from said rim, said rim forming a space with said preventing means for receiving a portion of said lid when said lid is arranged in said opened position.

43. The container of claim 30, wherein said second receptacle includes a bottom wall, said bottom wall arranged adjacent and overlying said opening within said top end of said first receptacle.

44. The container of claim 30, wherein said opening in said bottom end of said shell is substantially the same size and shape as said opening in said top end of said first receptacle.

45. A container for segregating materials, said container comprising a shell having opposed open ends, a first receptacle having an open top removably supporting one said open end of said shell to provide communication between the interiors thereof, and a second receptacle removably supported within said shell, said second receptacle having a portion spaced from a portion of said shell to form an open passageway extending in communication between the other said open end of said shell and the interior of said first receptacle, said shell including a front wall having an inclined portion extending outwardly from one said open end of said shell to the other said open end thereof, said inclined portion and the portion of said second receptacle forming said passageway.

46. A container for segregating materials, said container comprising a shell having top and bottom ends each provided with an opening therein, a first receptacle having a top end provided with an opening therein and a closed bottom end, said top end of said first receptacle removably supporting said bottom end of said shell with said openings thereof in at least partial alignment with each other to provide communication between the interiors thereof, a second receptacle removably supported within said shell, said second receptacle having a wall spaced from a wall of said shell to form a passageway therebetween, said wall of said shell including an inclined portion extending outwardly from said bottom end to said top end of said shell, said inclined portion and said wall of said second receptacle forming said passageway, said passageway providing communication between said opening in said top end of said shell and the interior of said first receptacle through the at least partially aligned openings within said bottom end of said shell and said top end of said first receptacle, and a lid moveably overlying said opening in said top end of said shell between an opened and closed position.

47. A container for segregating materials, said container comprising a shell having top and bottom ends each provided with an opening therein, a first receptacle having a top end provided with an opening therein and a closed bottom end, said top end of said first receptacle removably supporting said bottom end of said shell with said openings thereof in at least partial alignment with each other to provide communication between the interiors thereof, a second receptacle removably supported within said shell, said second receptacle having a wall spaced from a wall of said shell to form a passageway therebetween, said passageway providing communication between said opening in said top end of said shell and the interior of said first receptacle through the at least partially aligned openings within said bottom end of said shell and said top end of said first receptacle, said opening in said top end of said shell being larger than said opening in said bottom end of said shell, the differences between said openings forming a portion of said passageway therebetween, and a lid moveably overlying said opening in said top end of said shell between an opened and closed position.

48. A container for segregating materials, said container comprising a shell having top and bottom ends each provided with an opening therein, a first receptacle having a top end provided with an opening therein and a closed bottom end, said top end of said first receptacle removably supporting said bottom end of said shell with said openings thereof in at least partial alignment with each other to provide communication between the interiors thereof, a second receptacle removably supported within said shell, said second receptacle having a wall spaced from a wall of said shell to form a passageway therebetween, said passageway providing communication between said opening in said top end of said shell and the interior of said first receptacle through the at least partially aligned openings within said bottom end of said shell and said top end of said first receptacle, and a lid moveably overlying said opening in said top end of said shell between an opened and closed position, said shell including a rim surrounding a portion of said top end of said shell, said rim including preventing means for preventing movement of said lid in said opened position beyond a predetermined limit.

49. A container for segregating materials, said container comprising a shell having top and bottom ends each provided with an opening therein, a first receptacle having a top end provided with an opening therein and a closed bottom end, said top end of said first receptacle removably supporting said bottom end of said shell with said openings thereof in at least partial alignment with each other to provide communication between the interiors thereof, a second receptacle removably supported within said shell, said second receptacle having a wall spaced from a wall of said shell to form a passageway therebetween, a third receptacle removably supported within said shell adjacent said second receptacle, said wall of said shell forming said passageway extending outwardly from said bottom end to said top end of said shell, said walls of said second and third receptacles forming with said wall of said shell said passageway therebetween, said passageway providing communication between said opening in said top end of said shell and the interior of said first receptacle through the at least partially aligned openings within said bottom end of said shell and said top end of said first receptacle, and a lid moveably overlying said opening in said top end of said shell between an opened and closed position.

* * * * *